US006094885A

United States Patent [19]

Ranhotra

[11] Patent Number: 6,094,885

[45] Date of Patent: Aug. 1, 2000

[54] PACKAGING STATION

[75] Inventor: Anita Ranhotra, Topeka, Kans.

[73] Assignee: Payless ShoeSource, Inc., Topeka, Kans.

[21] Appl. No.: 09/123,619

[22] Filed: Jul. 28, 1998

[51] Int. Cl.[7] ..... B65B 43/42; B65B 67/02

[52] U.S. Cl. ..... 53/390; 53/392; 53/244; 53/473

[58] Field of Search ..... 53/475, 474, 473, 53/392, 391, 390, 564, 244, 243, 260

[56] References Cited

U.S. PATENT DOCUMENTS

| | | | |
|---|---|---|---|
| 1,238,248 | 8/1917 | Beckman | 53/390 X |
| 1,246,334 | 11/1917 | Sears | 53/390 X |
| 1,784,403 | 12/1930 | Walker | 53/390 |
| 2,057,284 | 10/1936 | Walker | 53/390 |
| 4,522,016 | 6/1985 | Di Rico | 53/564 |
| 4,909,697 | 3/1990 | Bernard, II et al. | 53/391 X |
| 5,778,640 | 7/1998 | Prakken et al. | 53/475 |

*Primary Examiner*—James F. Coan
*Attorney, Agent, or Firm*—Lathrop & Gage, LC

[57] ABSTRACT

A device is provided for assisting in the removal of articles from a first conveying system into a container and for reorienting the container for loading onto a second conveying system. The device comprises a base; a platform pivotally connected to the base, and an actuating mechanism configured to operatively pivot the platform. The platform has a panel and a lip operatively configured to cooperatively support and retain the container in a substantially inclined position substantially adjacent to the first conveying system for facilitating loading of articles into the container. The actuating mechanism pivots the platform and thus the container such that the panel assumes a substantially horizontal position for loading the container onto the second conveying system.

8 Claims, 2 Drawing Sheets

PACKAGING STATION

BACKGROUND OF THE INVENTION

1. Field of the Invention

The present invention relates to a station for packing individual products to be shipped as a group, and more specifically to a station that efficiently packs the products in a container with reduced stress to the shipping container and reduced exertion by the station operator.

2. Description of the Related Art

In today's fast paced world the speed of production is ever increasing. Assembly lines are moving faster to generate more product and increase corporate revenues. Moreover, the demand for on-time delivery without packaging errors from the vendor is becoming the norm in all sectors of industry, be it shoes, auto parts or medical equipment. Suppliers are threatened with the prospect of contract cancellation if they cannot deliver goods on time, in marketable condition, and without inventory errors. It has become a matter of corporate survival that every measure be taken that will enhance the ability to compete in the global marketplace. One of those measures is the development and installation of equipment to accomplish expedited production that does not damage the delivery container and yet also does not impair the rate of production. Tools that facilitate prompt delivery of error-free orders of undamaged goods are the tools that will separate companies that survive from those that will not.

These concerns are not the exclusive result of problems at the packaging facility, as rough handling in transit by a common carrier or simply delays in transit can raise the ire of the customer. Nonetheless, industry is perpetually besieged with problems arising from equipment that occasional, or even frequently, damages the shipping container while the container is being packed or while it is in transit to a wait station for shipment to the customer. Consequently, industry must carefully consider the configuration of packaging equipment and packaging stations to eliminate or at least minimize the prospect of damage to containers.

A concern also of paramount importance is the need to minimize, or prevent altogether, the prospect of injury to the operator that is packing the products into the shipping container. Injury is often caused through the operator's over-exertion because the shipping container is awkwardly positioned and cumbersome for packaging, or when the fully loaded container must be moved for purposes of shipping. Such packaging configurations defy productivity enhancements and serve to undermine worker safety.

DiRicio U.S. Pat. No. 4,522,016 discloses a mechanism for supporting a carton in an upright position during loading, and a mechanism for discharging the carton. It is also known to tilt a box during filling [See, e.g., Rouse U.S. Pat. No. 3,229,444, Morano U.S. Pat. No. 3,269,083, and Staley U.S. Pat. No. 3,585,782].

The above-described systems offer less than optimal performance with respect to compactness, overall reliability and to the efficiency and interrelationship of the station to the feeding and discharge conveyors as well as the simplicity of the overall mechanism. What is needed is a packing station that provides the desired ability to allow for rapid placement of packages within the container and yet minimize the physical exertion that must be performed by the operator.

SUMMARY OF THE INVENTION

An improved shipping container positioning and retaining device is provided for facilitating the removal of articles from a conveying system, packing of the articles into a container and loading the full container to another conveyer system. The positioning and retaining device comprises a platform pivotally connected to a base. The platform is biased in an inclined position and has a panel and a lip configured to support and stably retain the container in an inclined position. The device further includes an actuating mechanism designed to pivot the platform from its inclined position to a substantially horizontal position for sliding the container onto an adjacent conveyer system. An alternative embodiment of the invention may include a tension spring to facilitate the rotation of the panel about at least one edge of the retractable panel.

According to the present invention there is further provided a method of restraining, packing and discharging a container filled with articles which comprises placing a container onto a substantially upright and retractable panel, wherein the panel pivots about one edge and wherein an elevated lip substantially perpendicular to the retractable panel and parallel with an edge of the panel is configured to limit movement of the container. The method further comprises loading the container with articles that are conveyed to the container and an actuating a footpad operatively configured to lower the retractable panel to a substantially horizontal position. In addition, the method includes facilitating the transfer of the container to a final or intermediate destination upon completion of packing of the articles wherein the container is moved to an adjacent conveying system for transport.

PRINCIPAL OBJECTS AND ADVANTAGES OF THE INVENTION

The principal objects and advantages of the present invention is to provide an apparatus and method for facilitating the removal of articles from a conveying system into a container and re-positioning the container for loading onto a second conveying system. It is further an object of the present invention to provide a reliable and efficient device for this purpose which is compact and enables the operator to gain access to the container easily, thereby minimizing the potential for operator injury and the prospect for damage to the container.

DETAILED DESCRIPTION OF THE INVENTION

Figure 1:
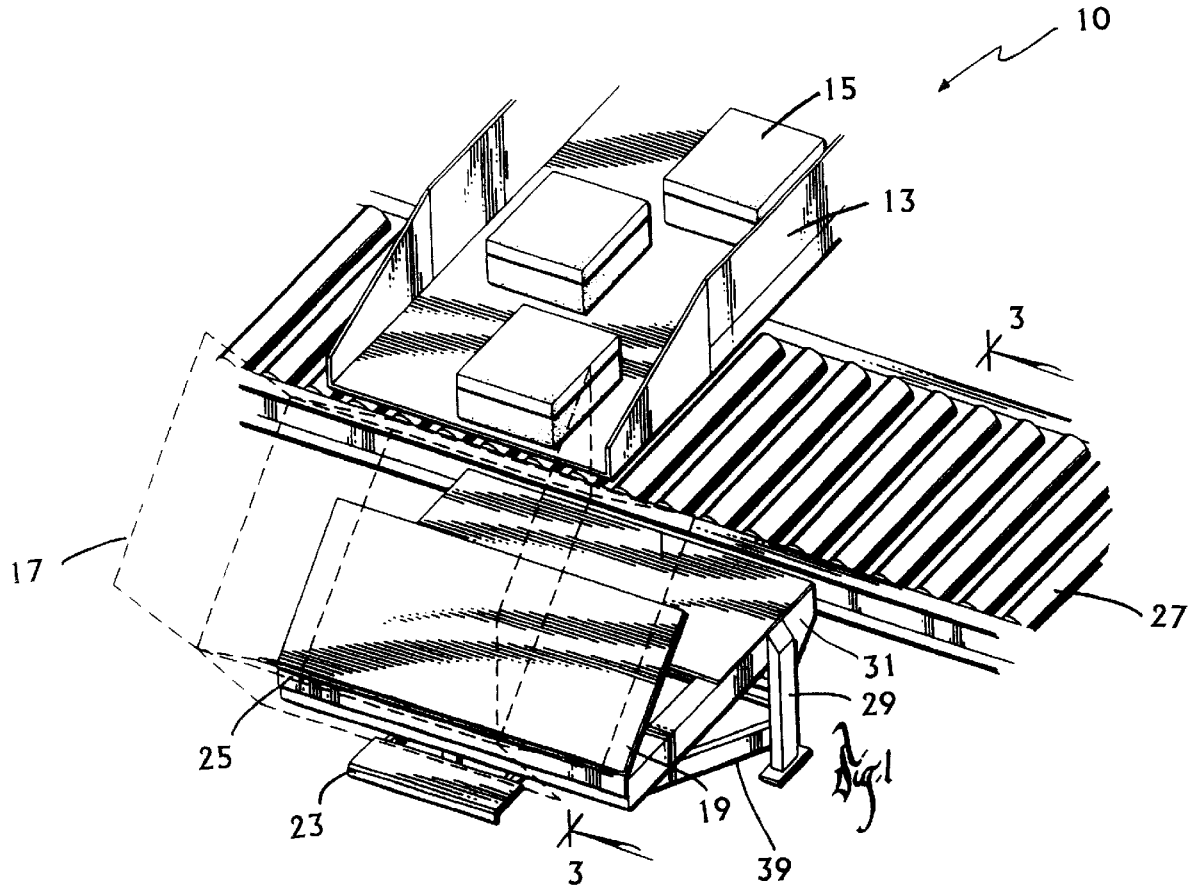
FIG. 1 is a perspective viewed from above the packing station showing it in an elevated position adjacent to the overhead feed conveyor and the discharge conveyor.
Figure 2:
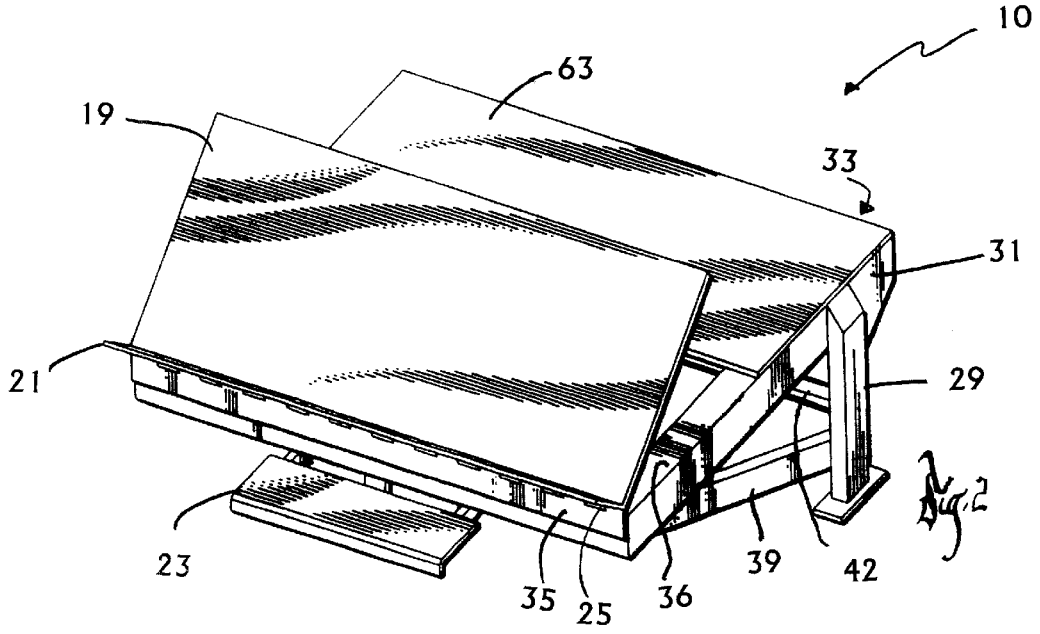
FIG. 2 is a view similar to FIG. 1 but illustrating the packing station without the phantom container or associated conveying equipment and on a larger scale.
Figure 3:
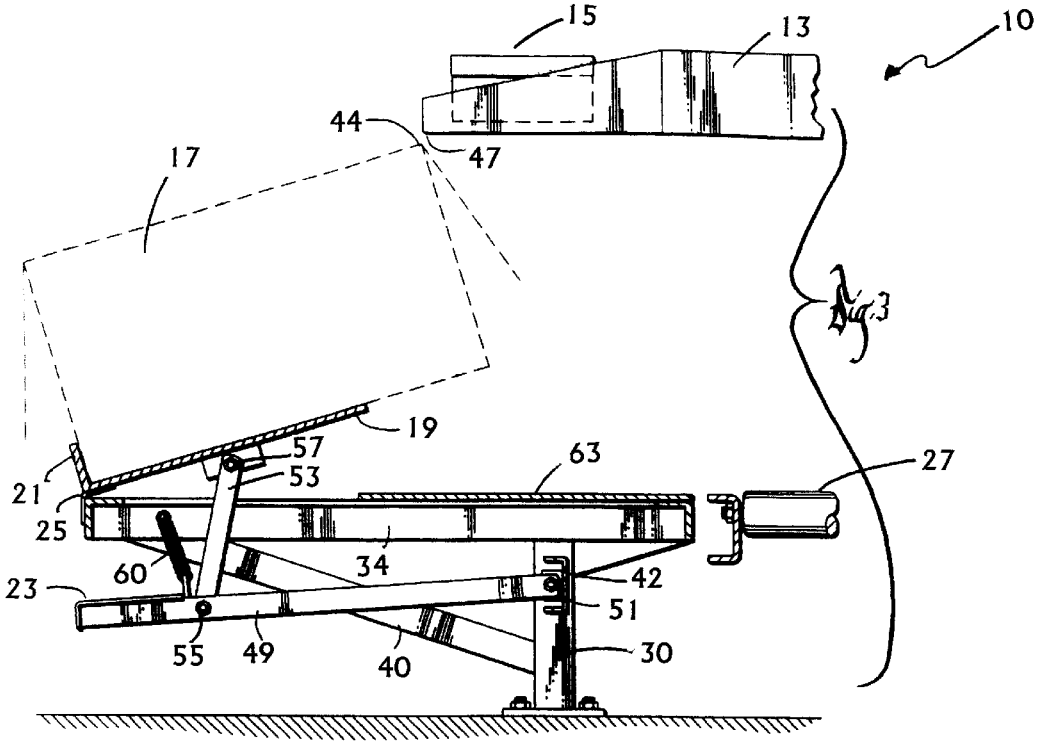
FIG. 3 is a sectional view taken at line 3—3 of FIG. 1 of the packing station in the elevated position with a phantom container ready to accept an article from an overhead conveyor.

In FIGS. 1–4, a shipping container positioning and retaining device or packing station is generally designated as 10. Referring initially to FIGS. 1 and 3, the packing station 10 is shown wherein an elevated conveyor system 13—or first means of conveyance—feeds articles 15 to a container 17 that is located atop the packing station's retractable panel 19. The container 17 is stably retained in an inclined position on the retractable panel 19 against an elevated lip 21. Preferably, the lip extends from an edge of the retractable panel at a position furthest away from the elevated conveyor system. When the container becomes filly loaded with articles 15, an operator depresses the footpad 23 which in turn rotates the retractable panel 19 about hinges 25. When the retractable panel is rotated to a substantially horizontal position, the operator can effortlessly slide the loaded container 17 onto a second means of conveyance, such as a second conveyor system 27.

At least two support legs 29, 30 are attached to, and elevate, the upper platform 31 which consists of four frame components 33, 34, 35 and 36. The support legs 29, 30 are firmly anchored to the floor by suitable means to prevent movement of the packing station while it is in operation. Frame components 33 and 35 run parallel to the second conveyor system 27 while frame components 34 and 36 run perpendicular to and are securely attached to the first two frame components 33, 35 to form a rectangular platform. It should be understood that the platform may be of many different configurations without departing from the scope of the present invention.

The retractable panel 19 is connected through a hinge 25 to the frame component 33 which is most distant from and running parallel to the conveyor system 27. To provide structural rigidity to the entire packing station 10, at least two support bars 39, 40 run between the support legs 29, 30 and the frame members perpendicular to the conveyor system 27. The support bars 39, 40 minimize the flexure associated with the cantilevered overhang of the upper platform 31 when containers 17 are being loaded and unloaded from the packing station 10. A cross member 42 that runs between, and is attached to each of the support legs, 29, 30 also serves to provide structural support by minimizing lateral movement.

As shown in FIG. 3, the outwardly extending lip is formed on the same edge where the retractable panel is pivotally connected to the base of the packing station. As such, the container can be held stably in an inclined position during the loading of articles into the container 17.

FIG. 3 depicts the packing station 10 with a phantom outline of a container 17 in an inclined position such that one edge of the container 44 is adjacent an end or drop point 47 of the input conveyor 13. The close proximity of the container edge 44 and the drop point 47 of the conveyor facilitates the manual packing of articles 15 into the container by an operator. An operator need not overexert themselves when moving the articles from the input conveyor 13 to the container 17. FIG. 3 also clearly depicts the various linkage members that are utilized in the operation of the packing station 10. The footpad 23 is attached to the footpad linkage 49 which in turn is rotatably secured to a hinge point 51 on the cross member 42. A connecting rod 53 joins the footpad linkage 49 to the retractable panel 19. The connecting rod lower point of attachment 55 and the connecting rod upper point of attachment 57 are both rotational points of attachment, such that as the footpad 23 is depressed and released, the connection points 55, 57 allow for rotation of the connecting rod 53 about the footpad linkage 49 and the retractable panel 19. A tensioning device 60, typically a spring, is utilized to bias the packing station 10 in a configuration with the retractable panel 19 in an inclined elevated position and the tensioning device being connected between the footpad linkage 49 and the upper platform 31. The tensioning device 60 also serves to raise the retractable panel 19 to the appropriate position wherein the container edge 44 is immediately adjacent to the input conveyor drop point 47.

Figure 4:
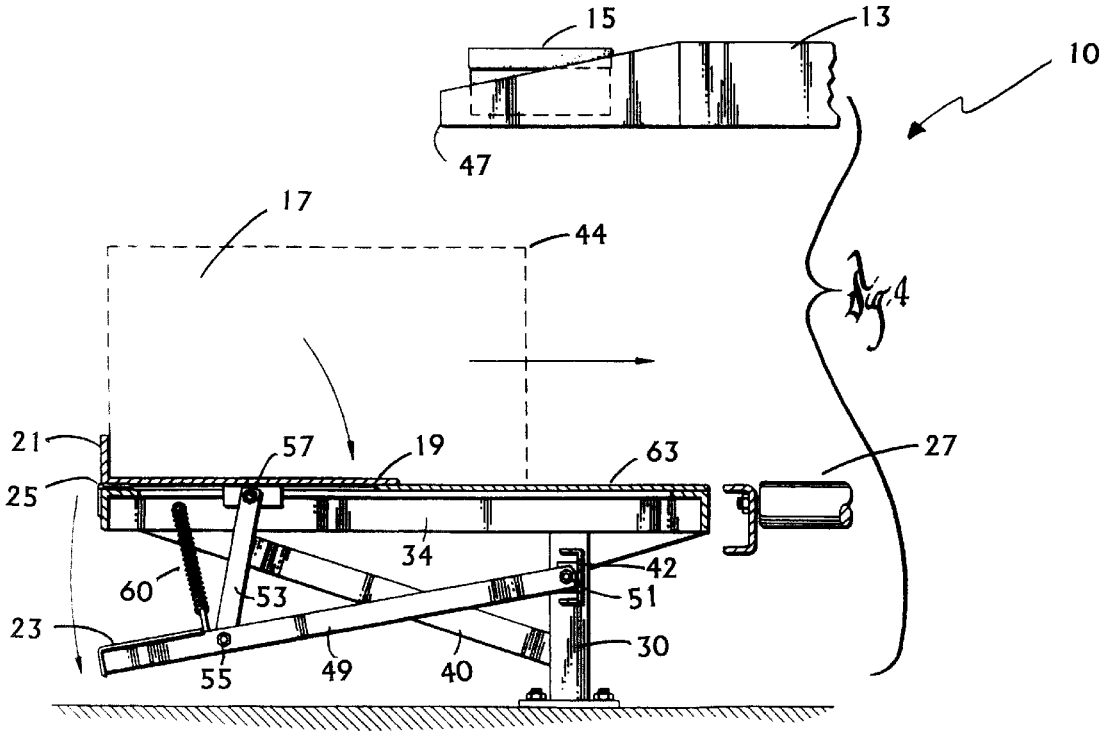
FIG. 4 is a sectional view taken at line 3—3 of FIG. 1 of the packing station with the retractable panel in the substantially horizontal position ready to discharge the phantom container to the conveyor system.

The retractable panel is pivotable to a substantially horizontal position, as shown in FIG. 4, for unloading the container 17 onto a second conveyor 27. To achieve this configuration of the packing station, the footpad 23 is depressed through the application of sufficient force to overcome the spring bias of spring 60. As the applied force overcomes the opposing force of the spring 60, the footpad linkage 49 begins to rotate about its hinge point 51. As the footpad rotates downward, the connecting rod 53 moves downward and in turn moves the retractable panel downward because of the connecting rod upper attachment 57. The ability of the connecting rod to rotate about both its upper and lower ends eliminates the possibility of binding of the connecting rod 55 at either of the upper or lower attachment points 55, 57.

Once the retractable panel is lowered into its substantially horizontal position, the container 17 can be slid forward and onto an overlapping plate 63 which provides support for the container as it progresses from the retractable panel to the second conveyor system 27. Once the original container is ejected, the next container can be repositioned upon the retractable panel 19, which is spring biased back to its inclined position, and again the elevated lip 21 and the footpad 23 released to repeat the packing process.

In operation, the operator loads a container 17 onto the retractable panel 19 of the packing station 10. The elevated conveyor system 13 feeds articles 15 to the container 17. The container 17 is stably retained in an inclined position on the retractable panel 19 against the elevated lip 21. The container is in close proximity to the edge 47 of this conveyor system 13 and the operator can easily load the shipping container 17 with the articles 15. When the container becomes fully loaded with articles 15, the operator depresses the footpad 23 which in turn rotates the retractable panel 19 about hinge 25. When the retractable panel is rotated to a substantially horizontal position, the operator can effortlessly slide the loaded container 17 onto a second conveyor system 27.

It is to be understood that the above embodiments are merely exemplary of the invention, which may be embodied in various forms. Therefore, specific structural and functional details disclosed herein are not to be interpreted as limiting, but merely as a basis for the claims and as a representative basis for teaching one skilled in the art to employ the present invention in virtually any appropriately detailed structure.

What is claimed is:

1. A device for assisting in the removal of articles from a first conveying system into a container and for reorienting the container for loading onto a second conveying system, the device comprising:

(a) a base;

(b) a platform having a smooth, retractable panel pivotally connected to the platform at an edge distal to said first conveying system and pivotal between an inclined position and a substantially horizontal position, and a substantially horizontal, smooth sliding panel extending substantially to said second conveying system, said retractable panel being biased in said inclined position and having a lip formed at the distal edge such that the retractable panel is operatively configured to cooperatively support and retain the container in a substantially inclined position substantially adjacent to the first conveying system as the retractable panel is in said inclined position, said retractable panel overlapping said sliding panel as pivoted to said horizontal position to thereby present a smooth, unobstructed surface on which to slide the container to said second conveying system; and (c) an actuating mechanism configured to operatively pivot said platform such that said retractable panel assumes a substantially horizontal position for loading the container onto the second conveying system.

2. The device of claim 1, wherein said actuating mechanism includes a footpad operatively configured to cooperatively engage a linkage system.

3. The device of claim 2, wherein said linkage system includes a spring mechanism.

4. The device of claim 1, wherein said retractable panel rotates about at least one edge of said retractable panel.

5. The device of claim 1, wherein said device is proximately located adjacent to a first means of conveyance for providing a steady flow of the articles.

6. The device in claim 5, wherein said retractable panel operatively aligns the container with said conveying system facilitating removal of articles from the conveying system.

7. The device of claim 1, wherein said device is proximately located adjacent to a second means for conveying the container.

8. The device of claim 1, wherein said device is configured to locate the retractable panel to a height to facilitate manual placement of the conveyed articles into the container.

* * * * *